United States Patent [19]

Aoyama

[11] Patent Number: 4,476,168

[45] Date of Patent: Oct. 9, 1984

[54] ARTIFICIAL-FLOWER-FORMING RIBBON

[75] Inventor: Ryuji Aoyama, Nagoya, Japan

[73] Assignee: Kabushiki Kaisha Aoyama, Nagoya, Japan

[21] Appl. No.: 496,933

[22] Filed: May 23, 1983

Related U.S. Application Data

[63] Continuation-in-part of Ser. No. 363,881, Mar. 31, 1982, abandoned.

[30] Foreign Application Priority Data

May 29, 1982 [JP] Japan ..... 57-79331[U]

[51] Int. Cl.[3] ..... A41G 1/00; D04D 7/10

[52] U.S. Cl. ..... 428/4; 223/46; 428/24; 428/198

[58] Field of Search ..... 428/4, 5, 24, 25, 26, 428/198; 223/46

[56] References Cited

U.S. PATENT DOCUMENTS

| | | | |
|---|---|---|---|
| 3,256,129 | 6/1966 | Wallerstein et al. | 428/5 |
| 3,632,464 | 1/1972 | Grikis | 428/4 |
| 3,637,455 | 1/1972 | Pearson et al. | 428/4 |
| 4,449,652 | 5/1984 | Coppins et al. | 223/46 |

*Primary Examiner*—Henry F. Epstein
*Attorney, Agent, or Firm*—Robert Scobey

[57] ABSTRACT

An artificial-flower-forming ribbon having an overlapped pair of strips and strings placed longitudinally in the middle of strips and therebetween. One end of the string is joined to those of the strips, and both strips are adhered to each other at a plurality of line areas spaced apart in the longitudinal direction of the strips so as to permit relative movements of the strips and the strings. The line areas are inclined with respect to the widthwise direction of the strips, the inclinations being alternately reverse.

12 Claims, 14 Drawing Figures

ARTIFICIAL-FLOWER-FORMING RIBBON

BACKGROUND OF THE INVENTION

This invention relates to a ribbon for forming an artificial flower, and this application is a continuation-in-part of copending application U.S. Ser. No. 363,881 filed on Mar. 31, 1982, abandoned, by the same inventor of this application.

One of the conventional artificial-flower-forming ribbons has an overlapped pair of strips joined to each other at one ends and a pair of strings placed along and between said strips also joined at one end with the ends of the strips. On both sides of the overlapped strips are made a plurality of notches equally spaced apart in the longitudinal direction of the strips and aligned widthwise to pair with each other. Around respective portions of the strips narrowed by the sets of notches are fitted metallic rings to surround the strings.

According to the conventional artificial-flower-forming ribbon, the parts between the narrowed portions of both strips gradually bend outwardly, each forming a petal by pulling apart the other ends of the strings or by drawing the other ends thereof by one hand with the neighboring portion of the strips held by the other hand, when the petals are oriented by the rings provided at the notches.

Accordingly, this conventional ribbon can form an artificial flower when needed. However, it is difficult to make definite orientations of the petals by this conventional ribbon, because it is the rings fitted at the narrowed portions that orient the petals. Therefore, the ribbon cannot easily form an artificial flower with uniformly and radially oriented petals. In addition, the artificial flower thus formed does not sufficiently look like a natural flower of which diameter decreases from the base to the top thereof as a whole, because of a uniform length of the petals.

Furthermore, the conventional ribbon requires notches on both sides of the strips and the rings to fit around these notches to such a disadvantage as to need a complicated manufacturing process.

According to the present invention, there is provided an artificial-flower-forming ribbon including a pair of strips having a plurality of line areas spaced apart by a certain longitudinal interval, respective line areas being inclined with respect to the widthwise direction of the strips, the inclinations being alternately reverse and the line areas being adhered to each other so that respective petals formed by bends of an overlapped pair of strips are oriented in the desired directions correctly. Additionally, one or more of the line areas may be parallel to the widthwise direction of the strip.

According to the present invention, orientation of respective petals are defined by said line areas so that the petals can be distributed in the circumferential direction of the flower. No notches and rings are required as in the conventional one so that the structure and manufacturing process can be more simplified.

It is an object of the present invention to provide an improved ribbon for forming an artificial flower.

SUMMARY OF THE INVENTION

According to the present invention an artificial-flower-forming ribbon comprising a pair of strips overlapped on each other; and at least a string placed longitudinally in the middle of said strips and therebetween, said string being joined to one ends of said strips at one end thereof, said strips being adhered to each other at a plurality of line areas respectively spaced apart in the longitudinal direction of said strips so as to permit relative movement of said strips and string, at least one of said line areas may be parallel to the widthwise direction of said strips, the others of said line areas being inclined with respect to the widthwise direction of said strips, and the inclination of the others of said line areas being alternately reverse.

In such an artificial-flower-forming ribbon, an artificial flower having petals arranged in the six radial directions can be formed without adjusting the orientation of the petals by hand.

DETAILED DESCRIPTION OF THE PREFERRED EMBODIMENTS

Figure 1:
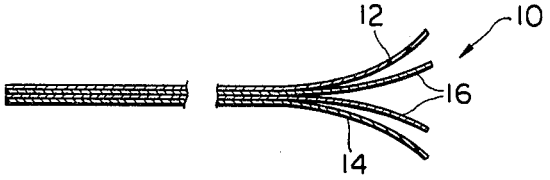
FIGS. 1 and 2 are respectively side and plan views showing the artificial-flower-forming ribbon according to the present invention.
Figure 2:
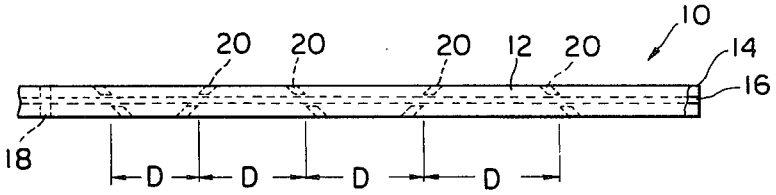

FIGS. 1 and 2 show the artificial-flower-forming ribbon of the present invention before forming a flower, the entire ribbon being indicated by reference numeral 10. The ribbon 10 consists of an overlapped pair of elongated strips 12, 14 and a pair of strings 16 placed along and between said strips. Strips narrower enough than the width of the strips 12, 14 can be used as the strings. The strings 16 are longitudinally placed between and in the middle of strips 12, 14 as clearly shown in FIG. 2. Both strips 12, 14 are joined together at the adhesive portions 18 provided near one end thereof where the strings 16 are adhered to both strips 12, 14. Strips 12, 14 can be formed by folding back a single strip, and by this, strips 12, 14 can be united at one ends. Also, the one ends of the strings 16 may be fastened to the strips 12, 14.

Strips 12, 14 are further adhered to each other at a plurality of line areas 20 spaced apart in the direction of the length of the strips 12, 14. In the example of FIG. 2, the strips are adhered to each other in the whole line areas 20 except for the middle portion to permit relative movements against the strips 12, 14 of the strings 16 placed in the longitudinal direction of the strips.

Respective line areas 20 are inclined at a certain angle, for example, of 45° with respect to the widthwise direction of the strips, the inclinations of which are alternately reverse. Also, the distance D between the line areas 20, viz., the distance D between the middle portions of respective line areas 20 gradually lengthens from the one end of the strips 12, 14 toward the other end thereof.

As an adhesive for the adhesive portion 18 and the line areas 20, a hot-melt adhesive such as polyvinyl acetate is preferable. Also, by using a heat-adhesion means with at least a pair of heat rollers (not shown) having a die for adhering the adhesive portion 18 and the line areas 20, both strip 12, 14 and the strings 16 can be combined by one heat-adhesion process. Further, successive forming of the ribbon 10 is practicable, and after that, a number of the ribbons 10 can be efficiently produced by cutting a prescribed portion as shown by A in FIG. 3.

Figure 4:
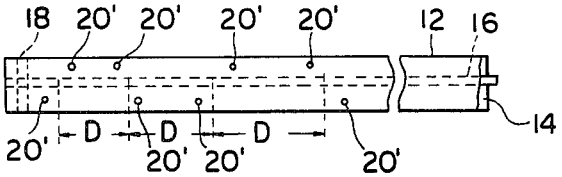
FIG. 4 is a drawing similar to FIG. 3 showing another embodiment of the present invention.

Instead of adhering both strips 12, 14 at the entire areas except for the above-mentioned middle portion through respective line areas 20, as shown in FIG. 4, the portions 20' on both sides of the strings 16 in the respective line areas 20 may be spot glued.

Figure 5:
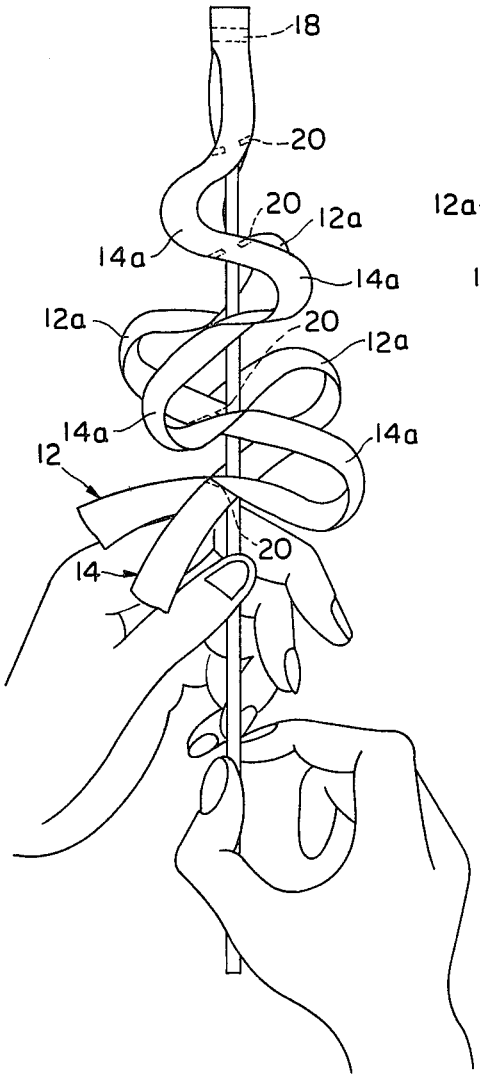
FIG. 5 is a perspective view of the artificial flower showing a manner of forming a flower by the ribbon of the present invention.
Figure 6:
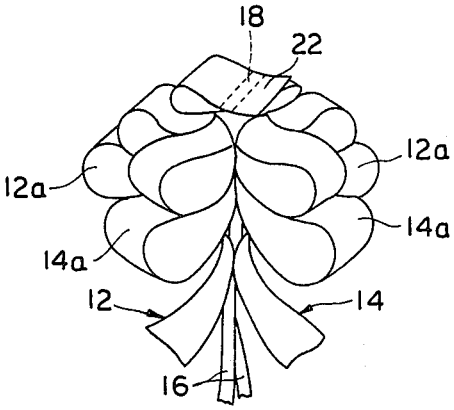
FIG. 6 is a perspective view showing the artificial flower formed by the ribbon of the present invention.

In order to form an artificial flower by the ribbon 10 of the present invention, hold near the other ends of the strips 12, 14 by one hand, for example, and pull the other end of strings downwards by another hand as shown in FIG. 5. This causes respective portions **12*a*, 14*a*, between the areas 20 of the strips to bend outwardly with the line areas 20 as folded lines. These bent portions 12*a*, 14*a* form petals, and, because petals are oriented by respective line areas 20 with an inclination of 45° with respect to the widthwise direction of the strips 12, 14, the portions 12*a* and the portions 14*a* in pairs make an angle of 90° to each other. Moreover, since the inclination angle of the line areas 20 is alternately reverse, respective petals 12*a*, 14*a* have a phase difference of 90° to each other. As the result, as shown in FIG. 6, an artificial flower with considerably uniformly distributed petals 12*a*, 14*a*** in cross-shape can be speedily formed.

Also, since the distance D between the respective lines areas 20 gradually lengthens as mentioned above, from the one ends of the strips 12, 14 toward the other ends, the petals **12*a*, 14*a* gradually shorten from the base of the flower toward the flower center 22** formed by the tip portions of the one ends.

Accordingly, while the distance D can be made equal, the artificial flower looks like more natural if the distance D varies to increase from the one ends toward the other ends of the strips.

The strings 16 can be used as strings to fasten the artificial flower to an article like a box. Only one string 16 may be used, but a pair of strings 16 can be used to tie around the article in two opposite directions or four strings 16 in four directions.

Figure 7:
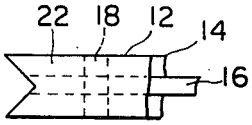
FIGS. 7 and 8 are respectively plan views showing further embodiments of shapes of the flower centers formed by the ribbon of the present invention.
Figure 8:
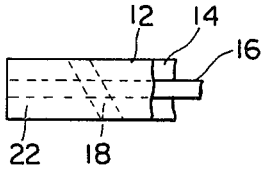

As shown in FIG. 7, by notching the tip portions of the strips 12, 14 in V-shape or, as shown in FIG. 8, by inclining the adhesive portion 18 to the direction of the width of the strips 12, 14, a desired form of flower center 18 can be made.

Figure 3:
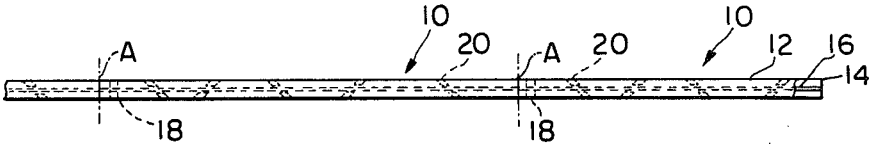
FIG. 3 is a plan view showing a production process of the ribbon shown in FIGS. 1 and 2.
Figure 9:
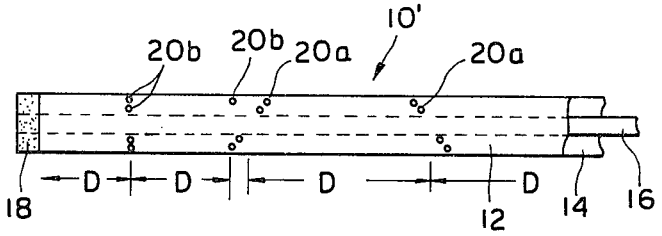
FIG. 9 is a drawing similar to FIG. 3 showing further embodiment of the present invention.
Figure 10:
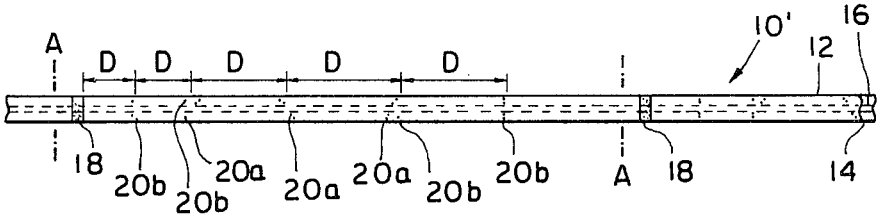
FIG. 10 is a drawing similar to FIG. 3 showing a production process of the ribbon shown in FIG. 9.

FIGS. 9 and 10 are drawings respectively similar to FIGS. 2 and 3 and show other embodiment of the ribbon 10' according to the present invention. In the embodiment shown in FIGS. 9 and 10, similarly to those shown in FIGS. 1 to 4, a pair of strips 12, 14 overlapped on each other are joined together at an adhesive portion 18 near one end thereof and extending in the widthwise direction of the strips. Further, each one end of a pair of strings 16 placed along and between both strips is adhered to both strips at the adhesive portion 18. Similarly to the above-mentioned embodiments, both strips 12, 14 may be integrated at one end. Both strips 12, 14 are further adhered to each other at a plurality of line areas **20*a*, 20*b* spaced apart from each other in the longitudinal direction of the strips. Respective line areas 20*a*, 20*b* are, as clearly shown in FIG. 9, defined at spot adhesive portions arranged to form a straight line, and the respective line areas 20*a*, 20*b* permit relative movements of the strings 16 at the middle portion in the longitudinal direction of the strips against both strips 12, 14**.

Near both end portions of strips 12, 14 are formed a pair of line areas **20*b* parallel to each other and extending in the widthwise direction of the strips respectively spaced apart in the longitudinal direction of the strips 12, 14, and in the central portion of the strips 12, 14 are formed line areas 20*a* inclined with respect to the widthwise direction of the strips 12, 14. The line areas 20*a* have an inclination angle, for example, of 45° with respect to the widthwise direction of the strips 12, 14, the direction of the inclination being alternately reverse in the longitudinal direction of the strips 12, 14**.

As clearly shown in FIG. 10, in respective pairs of the line areas **20*b* each one of the line areas 20*b* is approximate to the adjoining inclined line area 20*a*. Further, the distances between respective line areas 20*a*–20*b*, 20*a*—20*a* and 20*b*—20*b* except for the distances between the adjoining line areas 20*a*, 20*b* gradually lengthen from the one ends towards the other ends of the strips 12, 14**.

As shown in FIG. 10, a large number of ribbons 10' can be efficiently produced by successively forming and cutting same at the portions indicated by the reference A.

Figure 11:
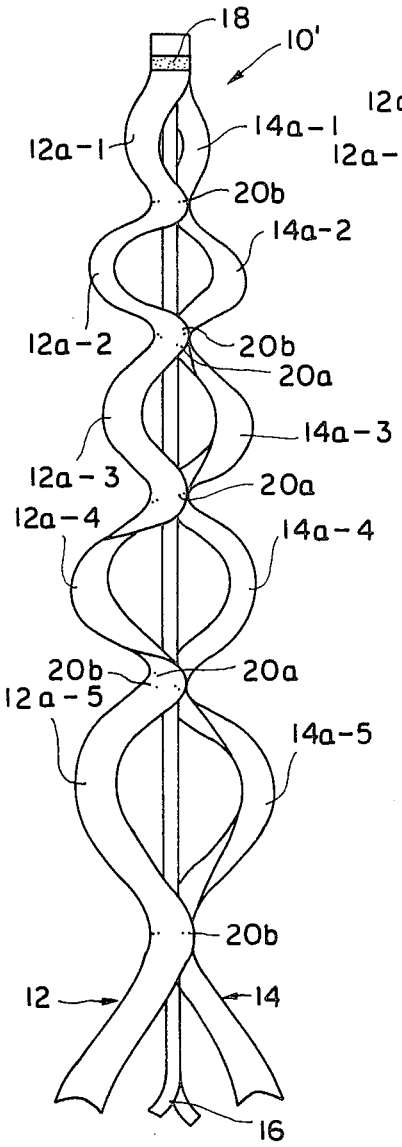
FIG. 11 is a drawing similar to FIG. 5 showing a manner of forming a flower by the ribbon shown in FIG. 9.
Figure 12:
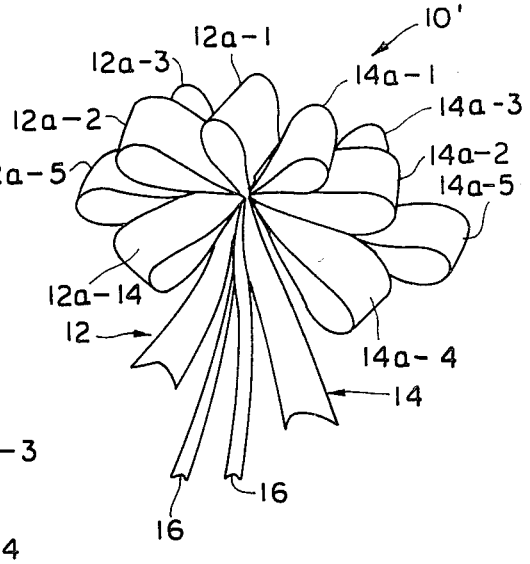
FIG. 12 is a perspective view of the flower formed by the ribbon shown in FIG. 9.

In order to form an artificial flower by the ribbon 10', as shown in FIG. 11, similar operations to those in the embodiment in FIG. 5 are made to the ribbon 10', so that the portions **12*a*-2 through 12*a*-5, 14*a*-2 through 14*a* -5 between respective line areas 20*a*, 20*b* and the portions 12*a*-1, 14*a*-1 between the adhesive portion 18 and one line area 20*b* adjoining thereto bend outwardly with the line areas 20*a* and 20*b* as folded lines. The bend portions 12*a*-1 to 12*a*-5 and 14*a*-1 to 14*a*-5 form petals as in the above-mentioned embodiments. Of these petals the portions 12*a*-3, 12*a*-4, 14*a*-3 and 14*a*-4 between the inclined line areas 20*a* have the inclined line areas 20 with an inclination angle of 45° so that they are oriented with a phase difference of 90° to each other. Further, since other petals 12*a*-1, 12*a*-2, 12*a*-5 and 14*a*-1, 14*a*-2, 14*a*-5 are oriented at the line areas 20*b* parallel to the widthwise direction of the strips 12, 14, they are placed in a straight line respectively between the petals 12*a*-3 and 4, 14*a*-3 and 4, as shown in FIG. 12**.

Figure 13:
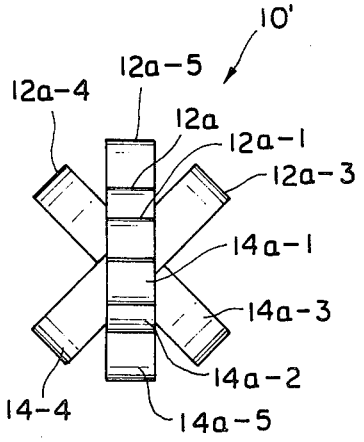
FIG. 13 is a plan view of the flower shown in FIG. 12.

As the result, according to the ribbon 10', as clearly shown in FIG. 13, in addition to the petals **12*a*-3, 12*a*-4, 14*a*-3 and 14*a*-4 distributed in the four directions in cross-shape, an artificial flower having petals in two more directions, i.e., 12*a*-1, 12*a*-2, 12*a*-5, 14*a*-1, 14*a*-2 and 14*a*-5** radially arranged in six directions can be speedily formed without adjusting the orientation of the petals by hand.

Figure 14:
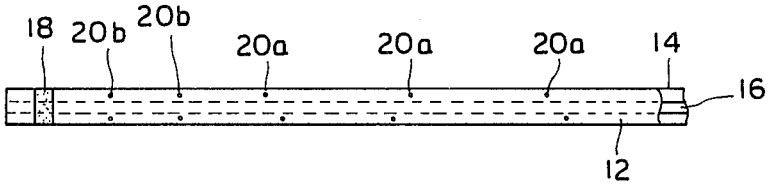
FIG. 14 is a plan view similar to FIG. 9 showing further embodiment of the present invention.

As shown in FIG. 14, there may be provided a space required to form the petals between one of the line areas 20*b* adjoining the inclined line areas 20*a*, of a pair of the line areas 20*b* placed near the one end of the strips 12, 14*a*, and the inclined line areas 20*a*. However, the petals, being oriented jointly by the line areas 20*b* agreeing with the widthwise direction of the strip 12, 14 and by the line areas 20*a* inclined with respect to the widthwise direction of the strips 12, 14, may be readily twisted. Accordingly, it is desirable to have the line areas 20*b* adjoining the inclined line areas 20*a* sufficiently approached (closely spaced) to the inclined line areas 20*a*, as shown in FIG. 10.

Also, though we have explained the embodiments with a plurality of pairs of line areas 20*b* parallel to each other provided in the widthwise direction of the strips 12, 14 in addition to a plurality of the inclined line areas 20*a* in FIGS. 9 and 14, it will be apparent that in place of these pairs of the line areas 20*b* an artificial flower having petals radially arranged in six directions can be obtained by providing a line area 20*b* parallel to and spaced apart from the adhesive portion 18.

In the foregoing, the case with the inclination angle of respective line areas 20, 20*a* at 45° was explained; however, in order to give a desired phase difference to the petals, the angle can be varied as desired.

According to the present invention, as already mentioned, petals can be oriented by the line areas adhering both strips together, whereby the petals can be oriented to the desired directions correctly without using rings.

Besides, since orientation of petals can be effected by the line areas adhering both strips together, no ring is used to form easily an artificial flower having uniformly distributed petals in the circumferential direction.

Furthermore, the structure and the production process can be simplified, since no rings and notches for the rings are needed.

Since the preferred embodiments above may be modified, as desired, the invention should be taken to be defined by the following claims.

What is claimed is:

1. An artificial-flower-forming ribbon comprising a pair of strips overlapped on each other; and at least a string placed longitudinally in the middle of said strips and therebetween, said string being joined to one ends of said strips at one end thereof, said strips being adhered to each other at a plurality of line areas respectively spaced apart in the longitudinal direction of said strips so as to permit relative movement of said strips and string, said line areas being inclined with respect to the widthwise direction of said strips, and the inclinations of said line areas being alternately reverse.

2. An artificial-flower-forming ribbon as claimed in claim 1, wherein said strips are adhered to each other additionally at one or more supplemental line areas parallel to the widthwise direction of said strips.

3. An artificial-flower-forming ribbon as claimed in claim 2, wherein said one or more supplemental line areas comprises a pair of line areas parallel to each other at a distance.

4. An artificial-flower-forming ribbon as claimed in claim 3, wherein one of said pair of said line areas parallel to each other is near to one of said inclined line areas.

5. An artificial-flower-forming ribbon as claimed in claims 1 or 2, wherein the pair of strips are united at the one ends thereof.

6. An artificial-flower-forming ribbon as claimed in claims 1 or 2, wherein the pair of strips are united by being adhered to each other at the one ends.

7. An artificial-flower-forming ribbon as claimed in claims 1 or 2, wherein the pair of stips are adhered at respective line areas except for the middle of said strips.

8. An artificial-flower-forming ribbon as claimed in claims 1 or 2, wherein the pair of strips are spot adhered together to define respective line areas on both sides of said strings.

9. An artificial-flower-forming ribbon as claimed in claims 1 or 2, wherein distances between respective inclined line areas gradually lengthen from the one end toward the other end of said strips.

10. An artificial-flower-forming ribbon as claimed in claims 1 or 2, wherein respective inclined areas have an inclination angle of about 45° with respect to the direction of the width of said strips.

11. An artificial-flower-forming ribbon as claimed in claims 1 or 2, wherein said at least one string comprises a pair of strings.

12. An artificial-flower-forming ribbon as claimed in claims 1 or 2, wherein said inclined line areas are inclined with respect to the widthwise direction of said strips at a substantially constant angle, whereby the portions between said line areas of said strips are oriented regularly generally on planes of a formed flower at right angles with respect to said string due to said line areas so that said portions are distributed uniformly in the circumferential direction when said string is operated to form a flower.

* * * * *

US004476168C1

(12) REEXAMINATION CERTIFICATE (4668th)

United States Patent

Aoyama

(10) Number: US 4,476,168 C1

(45) Certificate Issued: Nov. 12, 2002

(54) ARTIFICIAL-FLOWER-FORMING RIBBON

(75) Inventor: Ryuji Aoyama, Nagoya (JP)

(73) Assignee: Kabushiki Kaisha Aoyama, Nagoya (JP)

Reexamination Request:
No. 90/005,626, Feb. 1, 2000

Reexamination Certificate for:

| | |
|---|---|
| Patent No.: | **4,476,168** |
| Issued: | **Oct. 9, 1984** |
| Appl. No.: | **06/496,933** |
| Filed: | **May 23, 1983** |

(21) Appl. No.: 06/496,933

Related U.S. Application Data

(63) Continuation-in-part of application No. 06/363,881, filed on Mar. 31, 1982, now abandoned.

(30) Foreign Application Priority Data

May 29, 1982 (JP) ..... 57-79331 U

(51) Int. Cl.[7] ..... A41G 1/00; D04D 7/10

(52) U.S. Cl. ..... 428/4; 223/46; 428/198; 428/24

(58) Field of Search ..... 428/4, 5, 24, 25, 428/26, 198; 223/46; 112/411; 289/1, 2

(56) References Cited

U.S. PATENT DOCUMENTS

| | | | |
|---|---|---|---|
| 3,637,455 A | 1/1972 | Pearson et al. | 161/49 |
| 4,476,168 A | 10/1984 | Aoyama | 428/4 |

FOREIGN PATENT DOCUMENTS

| | | |
|---|---|---|
| IT | 162385 | 7/1973 |

*Primary Examiner*—Blaine Copenheaver

(57) ABSTRACT

An artificial-flower-forming ribbon having an overlapped pair of strips and strings placed longitudinally in the middle of strips and therebetween. One end of the string is joined to those of the strips, and both strips are adhered to each other at a plurality of line areas spaced apart in the longitudinal direction of the strips so as to permit relative movements of the strips and the strings. The line areas are inclined with respect to the widthwise direction of the strips, the inclinations being alternately reverse.

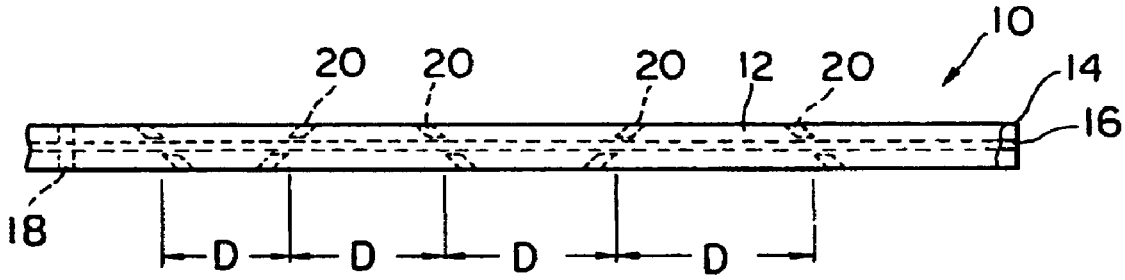

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–12 are cancelled.

* * * * *